US012048387B2

(12) United States Patent
Ohana

(10) Patent No.: US 12,048,387 B2
(45) Date of Patent: Jul. 30, 2024

(54) DRINKING VESSEL WITH A SPILLAGE RECEPTACLE

(71) Applicant: Golan Ohana, Moshav Merhavia (IL)

(72) Inventor: Golan Ohana, Moshav Merhavia (IL)

( * ) Notice: Subject to any disclaimer, the term of this patent is extended or adjusted under 35 U.S.C. 154(b) by 1449 days.

(21) Appl. No.: 16/099,244

(22) PCT Filed: May 7, 2017

(86) PCT No.: PCT/IL2017/050500

§ 371 (c)(1),
(2) Date: Nov. 6, 2018

(87) PCT Pub. No.: WO2017/195188

PCT Pub. Date: Nov. 16, 2017

(65) Prior Publication Data

US 2019/0099031 A1 Apr. 4, 2019

Related U.S. Application Data

(60) Provisional application No. 62/333,230, filed on May 8, 2016.

(51) Int. Cl.

| | |
|---|---|
| ***A47G 19/22*** | (2006.01) |
| ***A47G 23/03*** | (2006.01) |
| ***A47G 33/00*** | (2006.01) |

(52) U.S. Cl.

CPC ..... *A47G 33/002* (2013.01); *A47G 19/2205* (2013.01); *A47G 19/2255* (2013.01); *A47G 23/03* (2013.01)

(58) Field of Classification Search

CPC ..... A47G 33/002; A47G 19/2205; A47G 1/2255; A47G 23/03; A47G 23/0216; A47G 23/0225

See application file for complete search history.

(56) References Cited

U.S. PATENT DOCUMENTS

| | | | |
|---|---|---|---|
| 166,350 | A | 8/1875 | Dodge |
| 345,921 | A | 10/1888 | Buckland |

(Continued)

FOREIGN PATENT DOCUMENTS

| | | |
|---|---|---|
| CN | 204797423 | 11/2015 |
| DE | 52572 | 6/1890 |

(Continued)

OTHER PUBLICATIONS

PCT Search Report for International Application No. PCT/IL2017/050500 mailed Aug. 31, 2017, 5 pp.

(Continued)

*Primary Examiner* — Andrew T Kirsch

(74) *Attorney, Agent, or Firm* — The Roy Gross Law Firm, LLC; Roy Gross

(57) ABSTRACT

The invention discloses a drinking vessel comprising a beverage container and a spillage receptacle, the latter having an opening which excessively encompasses the vertical projection of the widest outer periphery of the beverage container. The spillage receptacle further comprises an annulated top surface designed to maintain the spillage in the spillage receptacle while the drinking vessel is tilted. The invention also provides a drinking vessel comprising a beverage container, a spillage receptacle which encompasses the vertical projection of the widest outer periphery of the beverage container, and an annulated draining surface (e.g. a funnel) wherein the top end of the spillage receptacle has a wider diameter than a lower holding portion of the drinking vessel, thus protecting the hand of the holder from spillage.

21 Claims, 7 Drawing Sheets

(56) References Cited

U.S. PATENT DOCUMENTS

| | | | | |
|---|---|---|---|---|
| 2,727,645 | A | 12/1955 | Dore | |
| 3,459,145 | A | 8/1969 | Ramsey et al. | |
| 3,633,863 | A * | 1/1972 | Abbey | A47G 23/0216<br>248/346.11 |
| 3,878,386 | A * | 4/1975 | Douglas | A47G 19/2227<br>362/101 |
| 2010/0116779 | A1 | 5/2010 | Erez et al. | |

FOREIGN PATENT DOCUMENTS

| | | |
|---|---|---|
| DE | 137481 | 12/1902 |
| FR | 358845 | 3/1906 |

OTHER PUBLICATIONS

PCT Written Opinion for International Application No. PCT/IL2017/050500 mailed Aug. 31, 2017, 6 pp.
PCT Preliminary Report on Patentability for International Application No. PCT/IL2017/050500 dated Nov. 13, 2018, 7 pp.

* cited by examiner

DRINKING VESSEL WITH A SPILLAGE RECEPTACLE

RELATED APPLICATIONS

This application is a National Phase of PCT Patent Application No. PCT/IL2017/050500 having International filing date of May 7, 2017, which claims the benefit of priority of U.S. Provisional Application No. 62/333,230 filed on May 8, 2016. The contents of the above applications are all incorporated by reference as if fully set forth herein in their entirety.

TECHNICAL FIELD

The present invention relates to drinking vessels.

BACKGROUND ART

The religious Jewish ritual wine sanctification known as "Kiddush", is carried out before sitting down to the Sabbath meal and other holiday meals and ceremonials. The Kiddush is traditionally accompanied by fully filling a wine glass (a "Kiddush cup") to the point of overflowing. The brimming cup is held by hand in the air while a blessing is recited. After the person reciting the Kiddush drinks from the wine, the remaining wine is usually passed around the table to the other participants. This activity is often accompanied with a certain amount of the wine being undesirably spilled, even when held with a stable hand, on the table, the floor or the dishes, causing stains and requiring clean-up.

The Kiddush cup is often accompanied with a matching tray to collect spilled drops from the cup. This tray is separate from the cup and is usually left on the table while the cup is raised during the blessing and when it passed to the other participants. Therefore, the tray provides an inadequate solution for spillage when the cup is raised from the tray.

Numerous solutions were disclosed for catching condensate drops which are formed on the outer wall of a drinking vessel containing a cold beverage or leftover drops after sipping that run down the exterior walls of a beverage glass. For Example see International Patent Application Nos. WO 2010/094104 and WO 2005/128675, U.S. Pat. Nos. 2,158,230 and 3,279,638, Japanese Patent Application Nos. JP H0586268U, JP H01151770U, JP 2006075206, German Patent No. DE 137481C, and French Patent No. FR 860414. U.S. Pat. No. 5,975,333 provides a drip catch beverage mug. The teachings of the prior art have numerous deficiencies which are addressed by the present invention.

SUMMARY OF INVENTION

In a first aspect the invention provides a drinking vessel comprising:

- a beverage container comprising a bottom end surface, and a cylindrical sidewall extending upward from the outer edge of the bottom end surface to a top edge defining a top end opening;
- a spillage receptacle having a bottom end, a cylindrical sidewall extending from the outer edge of the bottom end surface to a top edge defining a top end opening encompassing the vertical projection of the top end opening of the beverage container, the bottom end being lower than the top end opening of the beverage container;

- an annulated draining surface situated inside the spillage receptacle, having a top edge defining a top end opening, a cylindrical wall and drainage means, adapted to drain spillage from the beverage container into the spillage receptacle; and
- optionally a stem longitudinally extending downward from the bottom end surface of the spillage receptacle and connected to a base;

wherein a peripheral holding portion of the sidewall of the drinking vessel being below the top end opening of the spillage receptacle, being exposed for holding the drinking vessel and having a vertical length of at least 2 cm is characterized by having a diameter at least 2 cm shorter than the diameter of the top end opening of the spillage receptacle.

In a second aspect the invention provides a drinking vessel comprising:

- a beverage container comprising a bottom end surface, and a cylindrical sidewall extending upward from the outer edge of the bottom end surface to a top edge defining a top end opening;
- a spillage receptacle having a bottom end, a cylindrical sidewall extending from the outer edge of the bottom end surface to a top edge defining a top end opening, the bottom end being lower than the top end opening of the beverage container;
- an annulated draining surface situated between the beverage container and the spillage receptacle, having a top edge defining a top end opening positioned above the top end opening of the spillage receptacle and encompassing the vertical projection of the top end opening of the beverage container, a cylindrical wall and drainage means, adapted to drain spillage from the beverage container into the spillage receptacle; and
- optionally a stem longitudinally extending downward from the bottom end surface of the spillage receptacle and connected to a base;

wherein a peripheral holding portion of the sidewall of the drinking vessel being below the top end opening of the annulated draining surface, being exposed for holding the drinking vessel and having a vertical length of at least 2 cm is characterized by having a diameter at least 2 cm shorter than the diameter of the top end opening of the annulated draining surface.

- a beverage container having a bottom end surface, a cylindrical sidewall extending upward from the outer edge of the bottom end surface to a top edge defining a top end opening, the cylindrical sidewall having a widest outer periphery, and;
- a stem positioned below the beverage container having a top end and a bottom end; and
- a spillage receptacle positioned below the beverage container and the top end of the stem, having a bottom end, a cylindrical sidewall extending from the outer edge of the bottom end, an annulated top surface connected to the sidewall, and a peripheral top end having an opening, the sidewall and the annulated top surface adapted to collect and drain spillage from the beverage container into the receptacle and adapted to maintain said spillage while the drinking vessel is tilted;

the beverage container being connected to the top end of the stem, the stem being connected to the spillage receptacle, wherein the peripheral top end opening of the receptacle encompasses the vertical projection of the widest outer periphery of the container with a sufficient margin to effectively collect spillage of liquid from the container into the spillage receptacle.

In a another aspect the invention provides a kit comprising a drinking vessel as described in one of the aspects above and instructions for using the drinking vessel in a Kiddush.

In a third aspect the invention provides:

a beverage container having a bottom end surface, a cylindrical sidewall extending upward from the outer edge of the bottom end surface to a top edge defining a top end opening, the cylindrical sidewall having a widest outer periphery, and;

a stem positioned below the beverage container having a top end and a bottom end; and a spillage receptacle positioned below the beverage container and the top end of the stem, having a bottom end, a cylindrical sidewall extending from the outer edge of the bottom end, an annulated top surface connected to the sidewall, and a peripheral top end defining an opening, the sidewall and the annulated top surface adapted to collect and drain spillage from the beverage container into the receptacle and to maintain said spillage while the drinking vessel is tilted;

the beverage container being connected to the top end of the stem, the stem being connected to the spillage receptacle, wherein the peripheral top end opening of the receptacle encompasses the vertical projection of the widest outer periphery of the container with a sufficient margin to effectively collect spillage of liquid from the container into the spillage receptacle.

In another aspect the invention provides a kit comprising a drinking vessel of the invention and instructions for using the drinking vessel in a Kiddush.

In a further aspect the invention provides a drinking vessel as described in one of the aspects above for use as a Kiddush cup.

In yet another aspect the invention provides a Kiddush cup defined as the drinking vessel of one of the aspects above.

Although the invention is illustrated and described herein as embodied in example drinking vessels, the invention is not limited to the details shown because various modifications and structural changes may be made without departing from the invention and the equivalents of the claims. However, the construction and method of operation of the invention together with additional objects and advantages thereof will be best understood from the following description of specific embodiments when read in connection with the accompanying drawings.

BRIEF DESCRIPTION OF DRAWINGS

For better understanding of the present invention and in order to exemplify how it may be implemented in practice, several embodiments are hereby described, which should be interpreted only as non-limiting examples, with reference to the accompanying figures. It is noted that the sizes and scale of the embodiments presented in the figures are exemplary and non-limiting.

GENERAL DESCRIPTION

Figure 1:
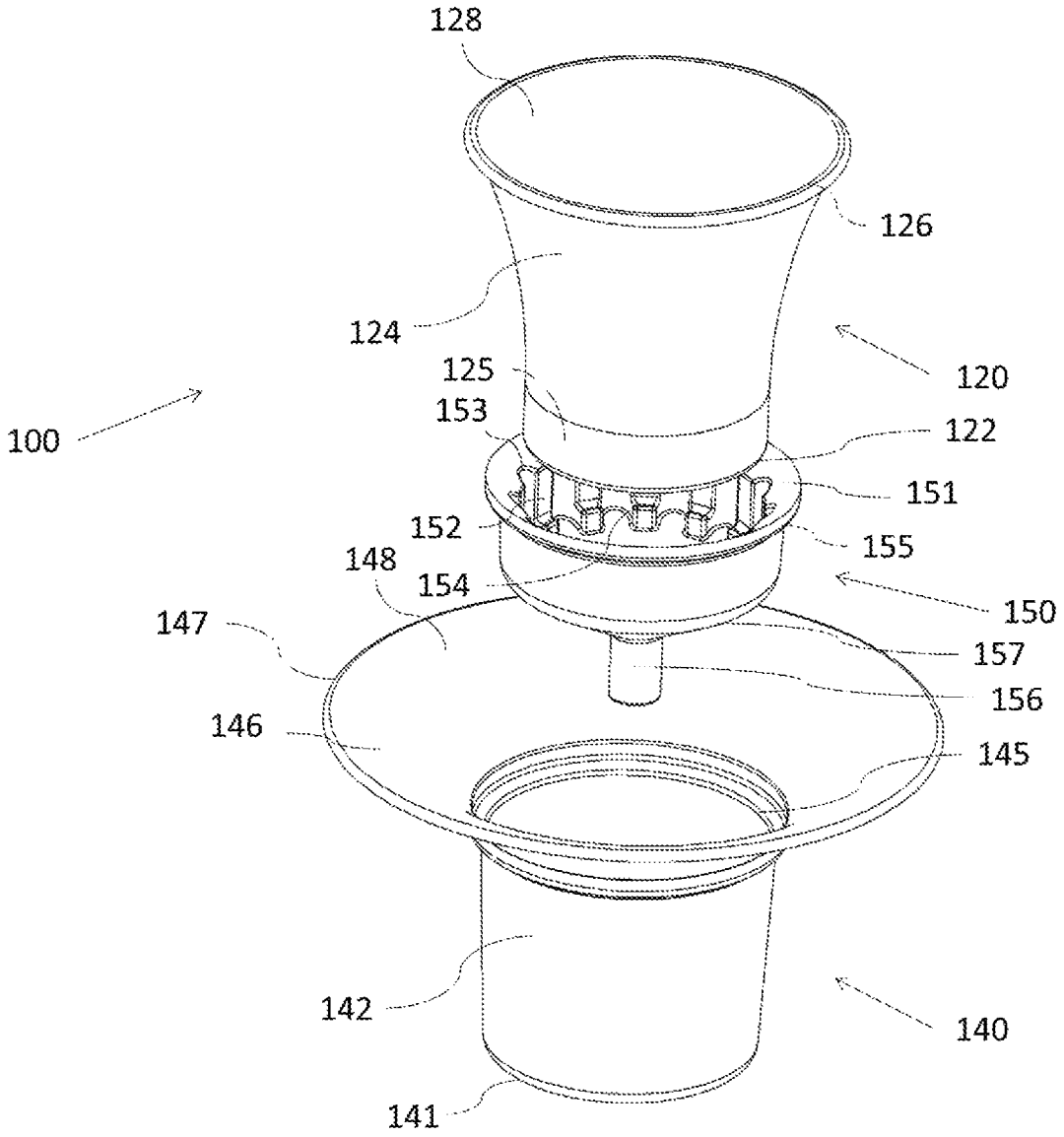
FIG. 1 depicts a three-dimensional schematic representation of a drinking vessel dismantled into its main parts according to an embodiment of the invention (except the stem and base).

The present invention provides an improved drinking vessel over the drinking vessels of the prior art which are used for drinking beverages, such as water, juices, milk, alcoholic beverages and in particular wine. A first object of the invention is to provide a solution for the problem of spillage of the beverage outside the beverage container component, by providing means for collecting and containing the spillage effectively. Another object of the invention is to provide protection from spillage on the hand which holds the drinking vessel. A further object of the present invention is to enable drinking from the vessel while preventing the collected spillage from being spilled. A yet further object of the present invention is to allow easy accessibility to all parts of the drinking vessel to facilitate its cleaning. Without being limited thereto, the drinking vessel of the invention particularly provides a solution for the spillage of wine which accompanies the event of ceremonial wine sanctification wherein wine is poured to fully fill the cup of the vessel as in the Jewish blessing over wine termed "Kiddush". Therefore, the invention in particular provides an improved Kiddush cup which addresses the problem of overflow. As the drinking vessel of the invention is adapted to collect possible spillage of beverage from the cup containing the beverage it is further fit to serve as a drinking vessel for people such as young children, elderly or disabled people having difficulties in stabilizing the drinking vessel while they drink from it.

The term "spillage" refers to liquid that is spilled from the beverage container outside of the beverage container, both along the outer wall of the beverage container as well as drops of beverage that are splashed further away from the outer sidewall of the beverage container. The term also refers to liquid that is improperly poured from a source of the beverage (usually a bottle or carafe) to the drinking vessel and either 'misses' the opening of the beverage container or pours outside of the beverage container due to overflow of the beverage when the beverage container is full to the brim.

The term "beverage container" as referred herein relates to a container having any form and design as customary drinking vessels known in the art such as glasses and cups, having a bottom end surface, a peripheral sidewall and a top end opening. The volume of the beverage container is also compatible with customary volume of beverage vessels. Without being limited thereto 50 ml, 100 ml, 200 ml, 330 ml 500 ml and 1000 ml are typical volumes for this purpose. In some embodiments, the volume of the beverage container between 81 ml and 161.5 ml, in some embodiments 86 ml, which is the traditional volume range for a Kiddush sanctification of wine.

According to some embodiments the beverage container is connected to the inner sidewall of the annulated draining surface. In some embodiments the outer sidewall of the beverage container is connected to the inner sidewall of the annulated draining surface. In some embodiments a lower section of the outer sidewall of the beverage container is connected to the outer sidewall of the annulated draining surface. According to some embodiments the bottom end surface of the beverage container is connected to the inner sidewall of the spillage receptacle. In some embodiments the beverage container is connected to the spillage receptacle with a stem. According to some embodiments the stem is connected at one end to the bottom end surface of the beverage container and at the other one to the annulated draining surface and/or to the spillage receptacle. In some embodiments the stem is replaced with a stage.

The top end opening of the beverage container is defined as the line formed by connecting the highest points of the beverage container, i.e. the top edge of the sidewall. Through the top end opening of the beverage container, beverage is poured into and out of the beverage container.

In some embodiments a portion of the sidewall of the beverage container which comes in contact with the annulated draining surface or the top annulated surface of the spillage receptacle comprises grooves which allow spillage to pass through and reach the spillage receptacle.

According to some embodiments the beverage container and the annulated draining surface are reversibly connected.

According to some embodiments the beverage container and the annulated draining surface comprise a fixation mechanism to secure the beverage container to the annulated draining surface in a manner that allows safe usage of the drinking vessel. According to some embodiments the fixation mechanism is a screw mechanism wherein the beverage container comprises an external thread and the annulated draining surface comprises a compatible internal thread, or vice versa.

According to some embodiments the fixation mechanism is obtained by having the annulated draining surface made of an elastic material having a wall thickness at a relaxed state in a portion of the annulated draining surface which comes in contact with the beverage container, which is larger than the gap between the external wall of the beverage container and the internal sidewall of the spillage receptacle, such that when the beverage container is placed inside the annulated draining surface, then the sidewall of the annulated draining surface is compressed between the beverage container and the spillage receptacle, and the compression force tightly holds the beverage container and the annulated draining surface in place.

In some embodiments a portion of the beverage container which comes in contact with the annulated draining surface, the top annulated surface or the sidewall of the spillage receptacle is reversible held by the counterpart it comes in contact with by having a slightly larger diameter than that of the latter.

According to some embodiments the fixation mechanism is a locking groove compatible with a protrusion on the outer side of the sidewall of the beverage container, or vice versa.

In order to prevent spillage of beverage on the hand of the person holding the drinking vessel, then according to some embodiments the spillage receptacle is designed to provide a cover to a portion of the drinking vessel which is intended to be held by the holder and being below said cover. To this end, in some embodiments, a peripheral holding portion of the sidewall of the drinking vessel being below the top end opening of the spillage receptacle, which is accessible and exposed for holding the drinking vessel (referred herein as "the holding portion") and having a vertical length of at least 2, 3, 4 or 5 cm is characterized by having a diameter at least 2, 3, 4 or 5 cm shorter than the diameter of the top end opening of the spillage receptacle. In some embodiments the diameter of the holding portion is between 3 to 5 cm shorter than the diameter of the top end opening of the spillage receptacle. In some embodiments the vertical length of the holding portion is at least 4 cm and the diameter of the holding portion is at least 4 cm shorter than the diameter of the top end opening of the spillage receptacle.

This structure defines an area which allows the drinking vessel holder to hold the drinking vessel at a holding portion of the drinking vessel while the top end opening of the spillage receptacle, shades the holding portion and the hand holding the drinking vessel area, collects spillage and prevents it from wetting the hand of the holder.

The holding portion can comprise portions of the sidewall of the beverage container (portions which of the beverage container which are lower than bottom end surface of the spillage receptacle), the spillage receptacle, the optional stem or a combination thereof. In some embodiments the peripheral holding portion is a portion of the sidewall of the spillage receptacle below the top end opening of the spillage receptacle. In some embodiments the peripheral holding portion is a portion of the sidewall of the beverage container being lower than the bottom end surface of the spillage receptacle. In some embodiments the peripheral holding portion is a stem connecting the spillage receptacle to a base.

The vertical length of the peripheral holding portion having the shorter diameter defined above, should be sufficient for holding the drinking vessel. At the very minimum, the drinking vesicle is held by the thumb and the index finger therefore, in order to accommodate a thumb and an index finger of the majority of the population the vertical length of the peripheral section of the drinking vessel which needs to be accessible and exposed for holding it should be at least 2 cm. In some embodiments the aforementioned vertical length is at least 3, 4, or 5 cm. in some embodiments the aforementioned vertical length is 3, 4, 5, 6, 7 or 8 cm. In some embodiment the vertical length varies along the periphery of the section. According to some embodiments the aforementioned vertical length varies between 2 to 5 cm, 2 to 6 cm, 2 to 7 cm, 2 to 8 cm, 3 to 5 cm, 3 to 6 cm, 3 to 7 cm, 3 to 8 cm, 4 to 5 cm, 4 to 6 cm, 4 to 7 cm or 4 to 8 cm.

There are many possible designs of the sidewalls of the exposed portions of the drinking vessel below the level of the top end opening of the spillage receptacle which may comply with the above requirement. For example, the outer sidewall of the spillage receptacle can have a concave structure, wherein an upper portion has a wider diameter than the lower portion. In some embodiments, the sidewall of the spillage receptacle is convex. In some embodiments, the widening of the spillage receptacle is gradual and in some embodiments it is stepwise. In embodiments where the drinking vessel has a stem having a diameter shorter than the diameter of the spillage receptacle and length as defined above, then the spillage receptacle can have a single diameter along its full length, and the stem serves as the holding portion of the drinking vessel.

In some embodiments the portion of the spillage receptacle including the top end of the spillage receptacle has a longer diameter than the holding portion. In some embodiments the portion of the spillage receptacle having a longer diameter than the holding portion is proximate to the top end of the spillage receptacle.

The term "spillage receptacle" relates to a container comprising a bottom end surface, a cylindrical sidewall extending from the outer edge of the bottom end surface to a top edge defining a top end opening. The combination of the spillage receptacle and the annulated draining surface is adapted to collect and contain drained spillage from the beverage container while the drinking vessel is tilted.

The top edge of the spillage receptacle is defined as the line formed by connecting the highest points of the spillage receptacle. The top end opening of the spillage receptacle resides on the top edge of the sidewall. In some embodiments the top end opening of the spillage receptacle is positioned above the annulated draining surface which resides inside the spillage receptacle. The opening of the top end (the top end opening) allows entry of spillage from the beverage container or missed pouring of liquid into the beverage container.

In order to collect spillage from the beverage container, the top end opening of the spillage receptacle encompasses the vertical projection of the top end of the beverage container. Thus, at least a portion of the top end opening of the spillage receptacle is at the same level or below the top end of the beverage container. In some embodiments the top end opening of the spillage receptacle is at the same level or below the top end of the beverage container. In some embodiments the spillage receptacle is external to the beverage container and surrounds it. In some embodiments the sidewall of the spillage receptacle surrounds at least a portion of the beverage container. In some embodiments the bottom end surface of the spillage receptacle is level with the bottom end surface of the beverage container. In some of these embodiments the bottom end surface of the spillage receptacle is an annulated surface about the bottom end surface of the beverage container. In some embodiments the bottom end surface of the spillage receptacle is below the bottom end surface of the beverage container. In some of these embodiments the beverage container is connected to the spillage receptacle through a stem, in some of these embodiments the beverage container is connected to the sidewalls of the spillage receptacle, and in some of these embodiments it is connected to the annulated draining surface.

In some embodiments the spillage receptacle is positioned under the beverage container such that at least a portion including the lowest point of the bottom end surface of the spillage receptacle is located below the top end of the beverage container. According to some embodiments the lowest point of the bottom end surface of the spillage receptacle is located below the bottom end surface of the beverage container. In some embodiments at least a portion of the top opening of the spillage receptacle is also located below the lowest point of the surface of the bottom end surface of the beverage container with sufficient margin to allow the access to a stem connecting the beverage container to the spillage receptacle, by the hand of the person holding the vessel. In some embodiments, this margin is at least 2 cm, 3 cm or 4 cm. In some embodiments this margin is 2, 3, 4, 5, 6, 7 or 8 cm long.

According to some embodiments the inner side of the bottom end surface of the spillage receptacle is flat. According to some embodiments the inner side of the bottom end surface of the spillage receptacle is tilted from the center, downward toward the outer edge proximal to the sidewall, for draining the spillage toward the sidewall.

The cylindrical sidewall of the spillage receptacle extends cylindrically upwards from the outer edge of the bottom end surface of the spillage receptacle. The sidewall of the spillage receptacle is straight, concave, convex or a combination of the three. The bottom surface and a lower portion of the inner side of the sidewall of the spillage receptacle together with the side of the annulated draining surface facing the base of the spillage receptacle form an inner volume of the spillage receptacle which is capable of holding the spillage from the beverage container. In some embodiments, the minimal height of the sidewall should be such that this volume is 10%, 15%, or 20% of the volume of the beverage container and/or not less than 5 ml. In some embodiments the inner volume of the spillage receptacle is at least 10 ml, 15 ml, 20 ml or 30 ml.

In some embodiments such as those in which the drinking vessel does not comprise a stem connecting the spillage receptacle to a base, the spillage receptacle may function as the supporting base of the drinking vessel. To this end, the outer wall of the bottom end surface of the spillage receptacle is designed to provide a level support for the drinking vessel. This can be achieved either by having the outer wall of the bottom end surface of the spillage receptacle being flat, or by having at least part of the lowest points of the outer wall of the bottom on the same plane.

The top end opening of the beverage container is typically the widest outer periphery of the container. However, in some embodiments the beverage container may be designed such that the sidewall comprises a diameter wider than the diameter of the top opening of the beverage container. For example, in embodiments where the sidewall has a convex outer surface then the top opening can be narrower than the periphery of the convex section. An example of such a design is a bell shaped (or pear shaped) glass wine where the widest outer periphery is closer to the bottom end surface of the container. In such embodiments, if the top end opening of the spillage receptacle is located below the widest outer periphery then the top end opening of the spillage receptacle should also encompass said widest outer periphery of the beverage container, in order to effectively collect the spillage. In such embodiments all the following reference to the margin between the top end opening of the spillage receptacle and the vertical projection of the top end opening should be replaced with the margin between the top end opening of the spillage receptacle and the vertical projection of the widest outer periphery of the beverage container.

The top end opening of the spillage receptacle can be designed in any desired closed ring shape such as cylindrical, polygon or have an amorphous shape, it may be symmetrical or asymmetric. In some embodiments an annulated surface extends from the top end opening of the spillage receptacle and bends inwards to form a groove which traps leftover drops of spillage that stayed on the inner surface of the spillage receptacle, or the annulated draining surface, when the drinking vessel is tilted while drinking.

The area of the shape that is formed by the top end opening of the spillage receptacle defines a "spillage collection area" wherein every drop of beverage which is spilled into this area is collected and drained into the spillage receptacle. The top end opening of the spillage receptacle must fully encompass the vertical projection of the widest circumference of the beverage container. In some embodiments the top end opening of the spillage receptacle must fully encompass the vertical projection of the widest circumference of the beverage container with a sufficient margin to allow the collection of a spilling drop, including drops which are splashed away from the edge of the beverage container. In some embodiments, the spillage receptacle thus functions to collect not only drops which run along the outer walls of the beverage container, but also to efficiently collect drops which are splashed sidewise away from the outer walls of the beverage container. The spillage drops are subject to gravitational forces that pull them downwards and also to horizontal vectors arising from miscalculated pouring of the beverage into the beverage container, overflow, an unstable holding of the drinking vessel by the person holding it, or movement of the surface on which the drinking vessel is held (e.g. a table). To this end, the margin between the top end opening of the spillage receptacle and the vertical projection of the top end opening of the beverage container should be sufficiently larger than the size of a drop, and in some embodiments larger than the distance that the drops travel when splashed away from the beverage container, to efficiently collect spillage from the beverage container. According to some embodiments the aforementioned margin should be at least 5 mm and up to 200 mm from the vertical projection of each point of the circumference of the circumference of the vertical projection of the top end opening of the beverage container.

According to some embodiments the aforementioned margin should be at least 5 mm, 6 mm, 7 mm, 8 mm, 9 mm, 10 mm, 11 mm, 12 mm, 13 mm, 14 mm, 15 mm, 16 mm, 17 mm, 18 mm, 19 mm, 20 mm, 21 mm, 22 mm, 23 mm, 24 mm, 25 mm, 26 mm, 27 mm, 28 mm, 29 mm, 30 mm, 31 mm, 32 mm, 33 mm, 34 mm, 35 mm, 36 mm, 37 mm, 38 mm, 39 mm, 40 mm, 42 mm, 44 mm, 46 mm, 48 mm, 50 mm, 55 mm, 60 mm, 65 mm, 70 mm, 75 mm, 80 mm, 85 mm, 90 mm, 95 mm, 100 mm, 105 mm, 110 mm 115 mm or 120 mm at each point of the circumference of the vertical projection of the top end opening of the container.

According to some embodiments the aforementioned margin is at most 10 mm, 11 mm, 12 mm, 13 mm, 14 mm, 15 mm, 16 mm, 17 mm, 18 mm, 19 mm, 20 mm, 21 mm, 22 mm, 23 mm, 24 mm, 25 mm, 26 mm, 27 mm, 28 mm, 29 mm, 30 mm, 31 mm, 32 mm, 33 mm, 34 mm, 35 mm, 36 mm, 37 mm, 38 mm, 39 mm, 40 mm, 42 mm, 44 mm, 46 mm, 48 mm, 50 mm, 55 mm, 60 mm, 65 mm, 70 mm, 75 mm, 80 mm, 85 mm, 90 mm, 95 mm, 100 mm, 105, 110 mm, 115 mm, 120 mm, 130 mm, 140 mm, 150 mm, 160 mm, 170 mm, 180 mm, 190 mm or 200 mm at each point of the circumference of the vertical projection of the top end opening of the beverage container.

According to some embodiments the aforementioned margin should be at least 5 mm, 6 mm, 7 mm, 8 mm, 9 mm, 10 mm, 11 mm, 12 mm, 13 mm, 14 mm, 15 mm, 16 mm, 17 mm, 18 mm, 19 mm, 20 mm, 21 mm, 22 mm, 23 mm, 24 mm, 25 mm, 26 mm, 27 mm, 28 mm, 29 mm, 30 mm, 31 mm, 32 mm, 33 mm, 34 mm, 35 mm, 36 mm, 37 mm, 38 mm, 39 mm, 40 mm, 42 mm, 44 mm, 46 mm, 48 mm, 50 mm, 55 mm, 60 mm, 65 mm, 70 mm, 75 mm, 80 mm, 85 mm, 90 mm, 95 mm, 100 mm, 105 mm, 110 mm 115 or 120 mm and at most 10 mm, 11 mm, 12 mm, 13 mm, 14 mm, 15 mm, 16 mm, 17 mm, 18 mm, 19 mm, 20 mm, 21 mm, 22 mm, 23 mm, 24 mm, 25 mm, 26 mm, 27 mm, 28 mm, 29 mm, 30 mm, 31 mm, 32 mm, 33 mm, 34 mm, 35 mm, 36 mm, 37 mm, 38 mm, 39 mm, 40 mm, 42 mm, 44 mm, 46 mm, 48 mm, 50 mm, 55 mm, 60 mm, 65 mm, 70 mm, 75 mm, 80 mm, 85 mm, 90 mm, 95 mm, 100 mm, 105, 110 mm 115 mm, 120 mm, 130 mm, 140 mm, 150 mm, 160 mm, 170 mm, 180 mm, 190 mm or 200 mm at each point of the circumference of the vertical projection of the top end opening of the beverage container.

According to some embodiments the aforementioned margin is between at least 5 mm and at most 150 mm at each point of the circumference of the vertical projection of the top end opening of the beverage container.

According to some embodiments the aforementioned margin is between 5 mm, 6 mm, 7 mm, 8 mm, 9 mm, 10 mm, 11 mm, 12 mm, 13 mm, 14 mm, 15 mm, 16 mm, 17 mm, 18 mm, 19 mm or 20 mm and 100 mm, 110 mm 120 mm, 130 mm, 140 mm, 150 mm, 160 mm, 170 mm, 180 mm, 190 mm or 200 mm.

According to some embodiments the aforementioned margin is between at least 5 mm and at most 150 mm at each point of the circumference of the vertical projection of the top end opening of the beverage container.

According to one embodiment the margin is variable in size about the periphery of the beverage container.

Another means to ensure that top end opening of the spillage receptacle excessively encompasses the vertical projection of the widest circumference of the beverage container, is by having a sufficient radial excess of the peripheral top end relative to the radius of the vertical projection of the widest circumference of the beverage container at each point along the periphery of the latter.

The radial excess AB is calculated by the subtracting the distance OA, being the distance of a point A on the top end opening of the receptacle from the center O of the vertical projection of the top end opening of the beverage container, from distance OB which is the distance of a point B on the periphery of the vertical projection of the top end opening of the beverage container, residing on the line OA, from the center O.

According to one embodiment the radial excess AB should be at least 5% of the distance OB. In other embodiments the radial excess AB should be at least 10%, 15%, 20%, 25%, 30%, 35%, 40%, 45%, 50%, 55%, 60%, 65%, 70%, 75%, 80%, 85%, 90%, 100%, 110%, 120%, 130%, 140%, 145% or 150% of the distance OB.

According to some embodiments, for practical reasons, the aforementioned radial excess should be limited to 100%, 110%, 120%, 130%, 140%, 150%, 200% or 250% of the distance OB.

According to some embodiments the radial excess should be between 5% to 100%, 5% to 110%, 5% to 120%, 5% to 130%, 5% to 140%, 5% to 150%, 5% to 200% or 5% to 250% of the distance OB.

According to some embodiments the radial excess should be between 10% to 100%, 10% to 110%, 10% to 120%, 10% to 130%, 10% to 140%, 10% to 150%, 10% to 200% or 10% to 250% of the distance OB.

According to some embodiments the radial excess should be between 15% to 100%, 15% to 110%, 15% to 120%, 15% to 130%, 15% to 140%, 15% to 150%, 15% to 200% or 15% to 250% of the distance OB.

According to some embodiments the radial excess should be between 20% to 100%, 20% to 110%, 20% to 120%, 20% to 130%, 20% to 140%, 20% to 150%, 20% to 200% or 20% to 250% of the distance OB.

According to some embodiments the radial excess should be between 25% to 100%, 25% to 110%, 25% to 120%, 25% to 130%, 25% to 140%, 25% to 150%, 25% to 200% or 25% to 250% of the distance OB.

According to some embodiments, the top end opening of the beverage container is round. In such cases, the diameter of the top end opening of the spillage receptacle should be longer than the diameter at each point around the circumference of the vertical projection of the top end opening of the beverage container by at least 10% (radial excess of at least 5% from each end of the diameter).

For aesthetic and comfort reasons, according to some embodiments the size of the margin is selected to be as minimal as possible but still be effective for collection of the majority of the spillage that might occur. As the distance by which the spillage may reach depends on the design of the specific drinking vessel, the person skilled in the art may conduct tests that will determine the reasonable spillage area. To this end, the beverage (e.g. wine or colored water) can be poured into a model drinking vessel comprising a beverage container, and optionally a stem and a supporting base. The stem and the beverage container of the model should have equivalent size measurements as in the final design and the supporting base should preferably have the same diameter of the widest outer periphery of the container. A series of pourings may be performed from several heights above the drinking vessel which should reasonably imitate real-life pouring situations, usually between 1 cm and 30 cm above the drinking vessel. A dozen pourings at each height with increments of 2-3 cm between each height is recommended, but variations are acceptable. Additionally, several tests may take place to imitate spillage due to unstable holding either manually or by using a mechanical shaker for higher consistency. In both sets of tests it is recommended to place a white paper, preferably non-absorbing, a few times wider than the widest outer periphery of the beverage container, under the drinking vessel model in order to allocate the landing spots of the drops. The distance of each drop from the projection of the top end opening of the beverage container should then be measured and recorded. By using the collected data a quantification should be conducted to determine the distance from the vertical projection of the top end opening of the beverage container in which a desired percentage of spilled drops (according to one embodiment above 90% of the drops, according to other embodiments above 93%, 95%, 95%, 97% or above 99%) reach. Alternatively, a series of tests can be conducted while placing the drinking vessel model in plastic bowls having different diameters, and finding the diameter of the bowl which collects the desired percentage of spilled drops (according to one embodiment above 90% of the drops, according to other embodiments above 93%, 95%, 97% or above 99%).

Accordingly, in some embodiments the top end opening of the spillage receptacle is larger than the projection of the top end opening of the beverage container by a margin which collects above 90%, 93%, 95%, 97% or above 99% of the spilled drops in model tests. In some embodiments the top end opening of the receptacle is larger than the projection of the top end opening of the beverage container by a margin which collects above 90% of the spilled drops in model tests.

In some embodiments of the present invention the combination of the spillage receptacle and the annulated draining surface defines an inner volume for containing the spillage according to the various examples provided in WO 2010/094104, while implementing the modification and improvement of the present invention: having the top end opening of the spillage receptacle encompassing the vertical projection of the top end opening of the beverage container with a sufficient margin to effectively collect spillage of liquid from the container, including drops spilled away from the walls of the container into the spillage receptacle. When adopting designs that are described in WO 2010/094104 for drinking vessels not having a stem, the necessary adjustment for having a stem in the current invention needs to be made, in particular, having the top end of the spillage receptacle sufficiently lower than the top end of the stem, to enable access for holding the vessel with the stem (typically, at least 2 cm, 3 cm or 4 cm lower).

The spillage receptacle may further comprise a drainage means located at any low point on the side wall adjacent to the bottom end surface or on the bottom end surface itself. The drainage means in some embodiments comprises a hole and a stopper located in the side wall or the bottom end surface. The stopper can be secured to the hole by any conventional means such as a thread and screw or by being made from an elastic compound such as rubber or plastic and be tightly fitted to the hole in methods well known in the art.

In some embodiments, the drinking vessel comprises an annulated draining surface. The term "annulated draining surface" refers herein to an annulated surface positioned between the beverage container and the spillage receptacle having a top peripheral edge, a bottom peripheral edge and drainage means which directs the spillage to a space inside the spillage receptacle.

In some embodiments the annulated draining surface is at least partially positioned inside the spillage receptacle. In some embodiments the annulated draining surface is fully positioned inside the spillage receptacle. In some embodiments the annulated draining surface is placed inside the spillage receptacle while an upper section of the sidewall of the annulated draining surface extends out through the top opening of the spillage receptacle such that the top edge of the annulated draining surface is positioned above the top edge of the spillage receptacle. In some embodiments at least part of the annulated draining surface is positioned out and above the spillage receptacle, and in some of these embodiments the annulated draining surface may be connected to the spillage receptacle through a stem. In some embodiments the aforementioned stem is an extension of a drainage stem of the annulated draining surface. In some embodiments the aforementioned stem is connected at is bottom end to the sidewall of the spillage receptacle. In some embodiments the aforementioned stem is connected at is bottom end to an annulated top surface of the spillage receptacle.

In embodiments where the top edge of the annulated draining surface extends above the top edge of the spillage receptacle, the top end opening of the annulated draining surface is required to encompass the vertical projection of the top end opening of the beverage container. In these embodiments the top end opening of the annulated draining surface should comply with the limitations detailed earlier for the top end opening of the spillage receptacle, instead of the latter, regarding the margin with respect to the vertical projection of the top end opening of the beverage container and regarding the wider diameter with respect to the holding portion of the drinking vessel.

In some embodiments, the side of the annulated draining surface facing the plane of the opening of the beverage container is at least partially sloped downwards towards the center and bottom end surface of the spillage receptacle allowing the spillage drops to drain into the spillage receptacle.

In some embodiments the section of the annulated draining surface which extends inwards and downwards is at least 3 mm, 5 mm, 7 mm, 10 mm or 15 mm wide. In some embodiments the section of the annulated draining surface which extends inwards and downwards has a tilt of at least 2%, 5%, 7%, 10%, 15%, 20% or 25%.

In some embodiments the side of the annulated draining surface facing the top end opening of the beverage container is perpendicular to the longitudinal axis of the drinking vessel and comprises at least one draining opening in its surface allowing the spillage to drain into the lower part of the spillage receptacle.

The lower section of the spillage receptacle being below the connection with the annulated draining surface is at least partially covered by the annulated draining surface which functions as a lid for containing the spillage in the lower section of the spillage receptacle while the drinking is tilted (for example, while drinking from the drinking vessel). In some embodiments, the side of the annulated draining surface facing the bottom end surface of the spillage receptacle serves as an annulated top surface of the spillage receptacle.

The annulated draining surface is connected to the internal sidewall of the spillage receptacle at an angle being equal or larger than a right angle (90°) which is defined as the angle between the sidewall of the spillage receptacle above the connection point with the annulated draining surface and the upper side of the annulated draining surface.

In some embodiments, the annulated draining surface is connected to the sidewall of the spillage receptacle at the top end of the sidewall. In some embodiments it may be connected to a lower point along the sidewall of the spillage receptacle or extend therefrom.

In some embodiments, where the annulated draining surface is connected to the sidewall of the spillage receptacle, a section of the side wall of the spillage receptacle which is connected to the annulated draining surface is detachable from the lower part of the spillage receptacle. In some of embodiments, where the annulated draining surface is connected to the sidewall of the spillage receptacle, a section of the spillage receptacle above the section of the spillage receptacle connected to the annulated draining surface, is attached in at least one point to the beverage container. In some of these embodiments, the drinking vessel can be separated to three parts: one part comprising the beverage container and the sidewall of the spillage receptacle parallel to the beverage container including its top end opening, a second part comprising the annulated draining surface and a section of the sidewall of the spillage receptacle to which it is connected, and a third part comprising the lower section of the spillage receptacle including the bottom end.

In some embodiments, the side of the annulated draining surface which faces the bottom end of the spillage receptacle is the top annulated surface of the spillage receptacle. In some embodiments the top annulated surface is an extension of the annulated draining surface which is bent to face the bottom end surface of the spillage receptacle. In some embodiments the top annulated surface is a separate surface which is connected to the sidewall of the spillage receptacle and positioned below the annulated draining surface.

In some embodiments, the annulated draining surface is connected to the sidewall of the spillage receptacle at a point above the bottom end surface of the spillage receptacle such that a gap, or groove, is formed between the annulated draining surface and the bottom end surface of the spillage receptacle. In some embodiments the annulated draining surface is connected to the sidewall of the spillage receptacle at a height of at least 5 mm, 7 mm, 10 mm or 15 mm above the bottom end surface of the spillage receptacle.

The annulated draining surface has an external end and an internal end, the internal end faces the inner sidewall of the spillage receptacle and the inner end faces the beverage container. In some embodiments the external end is connected to the entire periphery of the inner sidewall of the spillage receptacle.

The space in which the spillage is contained, is defined by the bottom end surface and lower sidewalls of the spillage receptacle and the side of the sidewall of the annulated draining surface which faces the bottom end surface of the spillage receptacle.

In some embodiments the annulated draining surface has drainage means in the form of at least one hole, slit, baffle, open ended hollow stem and/or aperture through which the spillage can drop into the inner volume of the spillage receptacle. According to some embodiments of the invention the annulated draining surface has an aperture which is located at the center of the annulated top surface, which is used as a drainage port for the spillage. In some embodiments the internal end is connected to the beverage container. In some embodiments the internal end is partially connected to the beverage container and partially defines at least one drainage opening. In some embodiments the internal end of the annulated draining surface is connected to the beverage container on and off, thus forming multiple drainage ports aside connection points which provide support to the beverage container. In embodiments where the internal end is fully connected to the beverage container, then the annulated draining surface comprises at least one drainage opening within its surface. In some embodiments the drainage opening is positioned at the lowest point of the annulated draining surface.

When the drinking vessel is held upright, then the spillage is contained in the space defined between the bottom end surface of the spillage receptacle and its sidewalls. In some embodiments, when the drinking vessel begins to tilt, then the spillage is contained between the sidewall of the spillage receptacle and the part of the bottom end surface proximal to the sidewall of the spillage receptacle. When the drinking vessel is tilted further, then the spillage is contained in a volume defined by the sidewall functioning as the bottom end surface and at least one of the part of the bottom end surface of the spillage receptacle proximal to the sidewall and the side of the annulated draining surface facing the bottom end surface of the spillage receptacle functioning as its sidewall(s). When the drinking vessel is tilted even further, the spillage liquid is contained between the sidewall and the annulated draining surface. It is advantageous that the annulated draining surface is curved or bent downwards at its end to provide an extra wall which keeps the spillage contained in the groove, while the drinking vessel is tilted strongly, even beyond 90°. At moderate tilting angles of the drinking glass or when there is only low volume of spillage, the spillage may be contained in the groove even without the extra curving or bend.

The annulated draining surface, according to some embodiments, is made from a flexible material such as rubber which renders it squeezable, allowing the drainage of the accumulated spillage.

According to some embodiments the annulated draining surface is reversibly connected to the spillage receptacle, the beverage container or both. This allows keeping the spillage from spilling out of the spillage receptacle while it is attached, but when removed it allows easy access to the inner volume of the spillage receptacle for cleaning. In some embodiments the annulated draining surface is integrally extending from the sidewall of the spillage receptacle. In some embodiments the annulated draining surface is integrally extending from the sidewall of the beverage container.

In some embodiments the annulated draining surface is adapted to fit in the gap between the beverage container and the spillage receptacle.

In some embodiments the annulated draining surface resides in the spillage receptacle in a stepwise groove which prevents it from falling down to the bottom end surface of the spillage receptacle.

According to some embodiments the annulated draining surface is a funnel. The term "funnel" as used herein refers to the commonly known article, being a pipe that is used to collect liquid or solids from a broad area into a receiving container. The funnel has a top wide opening having a substantially tapered shape ending at a drainage stem having a narrow opening which is narrower than the top opening. The receiving container in the context of the present invention is the spillage receptacle. In some embodiments the inner sidewalls of the funnel are sloped inwards and downwards top down. In some embodiments, the drainage of the funnel is positioned at the center of the bottom of the funnel. In some embodiments a portion of the sidewall of the funnel can be straight. In some embodiments a portion of the sidewall of the funnel is compatible with the outer sidewall of the beverage container, in order to secure the beverage container inside the spillage receptacle. Thus, in some embodiments, the portion of the external sidewall of the beverage container which comes in contact with the funnel as well as the inner sidewall of the funnel have straight walls, and in some embodiments both have sloped walls. In some embodiments the funnel comprises a thread for securing it to the spillage receptacle and/or the beverage container as discussed earlier.

In some embodiments the drainage means is positioned off-center. In some embodiments, the funnel comprises at least one hole and/or at least one recess that drain the spillage into the spillage receptacle along the sloped wall. In some embodiments the drainage outlet is straight, and in some embodiments the drainage stem is curved. A curved drainage outlet makes it easier to keep the spillage entrapped in the spillage receptacle while the drinking vessel is tilted when it is used for drinking. In some embodiments the drainage comprises a check valve.

In some embodiments, the spillage receptacle is connected to an "annulated top surface" which refers herein to a surface facing the plane of the bottom end surface of the spillage receptacle at varying angles of less than 90° relative to the plane of the bottom end surface (in cases where the bottom end surface is not planar—relative to the tangent plane of the lowest point of the bottom end surface of the spillage receptacle). In some embodiments the other side of the surface faces the plane of the opening of the beverage container. The annulated top surface extends inwards from top to bottom towards the center of the spillage receptacle, while leaving an aperture above the bottom end. Thus, the annulated top surface forms a partial cover to the spillage receptacle component.

In some embodiments the side facing the plane of the opening of the beverage container at least partially sloped downwards towards the center and bottom end surface of the spillage receptacle allowing the spillage drops to drain into the spillage receptacle, and thus serves as an annulated draining surface of the drinking vessel.

In some embodiments the annulated top surface is connected to the sidewall of the spillage receptacle. In some embodiments, the annulated top surface is connected to the sidewall of the spillage receptacle at a point above the bottom end surface of the spillage receptacle such that a gap, or groove, is formed between the annulated top surface and the bottom end surface of the spillage receptacle. In some embodiments the annulated top surface is connected to the sidewall of the spillage receptacle at a height of at least 5 mm, 7 mm, 10 mm or 15 mm above the bottom end surface of the spillage receptacle.

In some embodiments, the annulated top surface is an integral section of the sidewall, or an integral extension thereof. In some embodiments it is a detachable surface in the form of a lid. In some embodiments the detachable part includes the annulated top surface and at least part of the sidewall.

The annulated top surface may be straight curved or curled. It may extend from the top end of the side walls or it may extend from a lower point along the inner surface of side walls. In some embodiments, the side of the annulated top surface facing the plane of the opening of the beverage container is adopted to allow the sliding of spillage drops into the spillage receptacle, i.e. it serves as an annulated draining surface. To this end, at least part of the surface of the annulated top surface which faces the plane of the opening of the beverage container is bent inwards and downwards toward the center and bottom of the spillage receptacle. In some embodiments the section of the annulated top surface which extends inwards and downwards is at least 3 mm, 5 mm, 7 mm, 10 mm or 15 mm wide. In some embodiments the section of the annulated top surface which extends inwards and downwards has a tilt of at least 2%, 5%, 7%, 10%, 15%, 20% or 25%.

The annulated top surface has draining means in the form of at least one hole, slit, baffle, open ended stem and/or aperture through which the spillage can drop into the inner volume of the spillage receptacle. According to some embodiments of the invention the annulated top surface has an aperture which is located at the center of the annulated top surface. In some embodiments the aperture is located around the stem. In some embodiments the aperture is located at the lowest point of the annulated surface.

The sidewall of the receptacle and at least one of: (i) the part of the bottom end surface proximal to the sidewall and (ii) the annulated top surface, define a groove capable of containing spilled liquid when the drinking vessel is tilted (while drinking or when the cup is unstably held in the air). In some embodiments, when the drinking vessel begins to tilt, then the spillage is contained between the sidewall and the part of the bottom end surface proximal to the sidewall. When the drinking vessel is tilted further, then the spillage liquid is contained in a volume having the sidewall as the bottom end surface and at least one of the part of the bottom end surface of the spillage receptacle proximal to the sidewall and the annulated top surface functioning as its sidewall (s). When the drinking vessel is tilted even further, the spillage liquid is contained between the sidewall and the top annulated surface. It is advantageous that the annulated top surface is curled or bent downwards at its end to provide an extra wall which keeps the spillage contained in the groove, while the drinking vessel is tilted strongly, even beyond 90°. At moderate tilting angles of the drinking glass or when there is only low volume of spillage, the spillage may be contained in the groove even without the extra curling or bend.

According to an embodiment of the invention the annulated top surface is in a form of a lid adapted to be tightly fitted to the sidewall of the receptacle for covering the opening of the spillage receptacle and having at least one of hole, slit, baffle or a combination thereof allowing spillage drain into the inner volume of the spillage receptacle. According to some embodiments the lid is adapted to be tightly fitted to the top edge of the sidewall. According to other embodiments it is adapted to be tightly fitted to an inwards extension of the sidewall (i.e. the annulated top surface is partially integrally connected to the sidewall and partially in the form of a lid). According to some embodiments the lid is fitted to a level below the top edge of the sidewall. According to some embodiments the lid is screwed into a thread in the sidewall of the spillage receptacle. According to some embodiments the lid includes the annulated top surface and a section of the side wall. According to some embodiments the lid includes the top annulated surface and the sidewall, and it tightly fits to the bottom end surface of the spillage receptacle.

The lid according to some embodiments is made from a flexible material such as rubber which renders it squeezable, allowing the drainage of the accumulated spillage. Alternatively or additionally the lid is detachable and allows keeping the spillage from spilling out of the spillage receptacle while it is attached, but when removed it allows easy access to the inner volume of the spillage receptacle for cleaning.

The spillage receptacle may further comprise a drainage means located at any low point on the side wall adjacent to the bottom end surface or on the bottom end surface itself. The drainage means in some embodiments comprises a hole and a stopper. The stopper can be secured to the hole by any conventional means such as a thread and screw or by being made from an elastic compound such as rubber or plastic and be tightly fitted to the hole in methods well known in the art.

According to an embodiment of the invention the inner side of the surface consisting of the sidewall and the annulated top surface of the spillage receptacle is concave in its lower part proximal to the bottom end surface of the spillage receptacle and its upper part proximal to the peripheral opening rim is convex (from an interior point of view). This configuration accomplishes two objectives—the lower part having a concave structure holds the spillage even at high tilt angles while drinking from the drinking vessel and the upper convex part allows a broad opening of the top of the spillage receptacle, making it easier to encompass the vertical projection of the widest diameter of the beverage container.

In some embodiments the drinking vessel comprises a stem or a plurality of stems connected to the bottom end surface of the spillage receptacle and extends downwards towards a supporting base. In some embodiments the drinking vessel comprises a stem connecting the beverage container with the spillage receptacle. In some embodiments the spillage receptacle is connected to a stem connecting the spillage receptacle to a supporting base below the spillage receptacle as well as a stem connecting the beverage container to the spillage receptacle.

The stem generally has a rod-like structure having a top end and a bottom end. The stem can be designed by straight or curved lines. In some embodiments the supporting base is in the form of a leg or plurality of legs which hold the entire drinking vessel.

According to an embodiment of the invention is provided a drinking vessel having a spillage receptacle for collecting spillage which is designed to provide protection from spillage for the hand holding the drinking vessel.

The drinking vessel comprises:

A beverage container comprising a bottom end surface, and a cylindrical sidewall extending upward from the outer edge of the bottom end surface to a top end having an opening;

A spillage receptacle comprising a bottom end surface, a cylindrical sidewall extending from the outer edge of the bottom end surface to a top edge defining a top end opening, the spillage receptacle encompassing the vertical projection of the top end opening of the beverage container;

An annulated draining surface situated inside the spillage receptacle connected to the inner sidewall of the spillage receptacle and comprising a drain outlet, adapted to drain spillage from the beverage container into the receptacle; and optionally a stem and a base longitudinally extending downward from the bottom end surface of the spillage receptacle.

According to another embodiment the present invention provides a drinking vessel comprising:

A beverage container having a bottom end surface, a cylindrical sidewall extending upward from the outer edge of the bottom end surface to a top edge defining a top end opening, the cylindrical sidewall having a widest outer periphery;

A stem positioned below the beverage container having a top end and a bottom end; and A spillage receptacle positioned below the beverage container and the top end of the stem, having a bottom end, a cylindrical sidewall extending from the outer edge of the bottom end, an annulated top surface connected to the sidewall, and a peripheral top end defining an opening, the sidewall and the annulated top surface adapted to collect and drain spillage from the beverage container into the receptacle and to maintain said spillage while the drinking vessel is tilted;

The beverage container being connected to the top end of the stem, the stem being connected to the spillage receptacle, wherein the peripheral top end opening of the receptacle encompasses the vertical projection of the widest outer periphery of the container with a sufficient margin to effectively collect spillage of liquid from the container into the spillage receptacle.

The drinking vessel according to the invention in any of the embodiments described above are characterized as follows.

Each one of the components or optional components of the drinking vessel, i.e. the beverage container, the spillage receptacle, the stem, base, the top annulated surface and the annulated draining surface can be integrally connected or modularly detachable.

The drinking vessel can be made from any customary material known to the person versed in the art such as glass, clay, porcelain, stainless steel, aluminum, anodized aluminum, nickel, silver, gold, thermoplastic materials, elastomers or a combination thereof. Generally, most wine cups for Kiddush are made of glass, silver or stainless steel. A combination of materials is also optional, for example, a silver cup having a gold covered interior, and an elastomeric funnel. The vessel may include ornamentals and writings. The surface of the components of the drinking vessel, especially the annulated draining surface and the spillage receptacle can be made of or covered with hydrophobic material to promote sliding of spillage into the essentially closed volume of the spillage receptacle.

The vessel can be prepared by any customary method known to the person skilled in the art, such as compression molding extrusion molding, injection molding and others.

The invention provides in another aspect a kit comprising a drinking vessel according in accordance with any one of the two aspects of the invention as described above and instructions for using the drinking vessel in a Kiddush. The kit may include the drinking vessel wherein all its components are assembled, or it may include the components or some of the components as separate parts, optionally with instructions of how to assemble the components together, and where applicable, how to disassemble the components in order to allow easy access for cleaning the drinking vessel. In some embodiments the kit may include the text of the Kiddush blessing over the wine.

DESCRIPTION OF EMBODIMENTS

Figure 2:
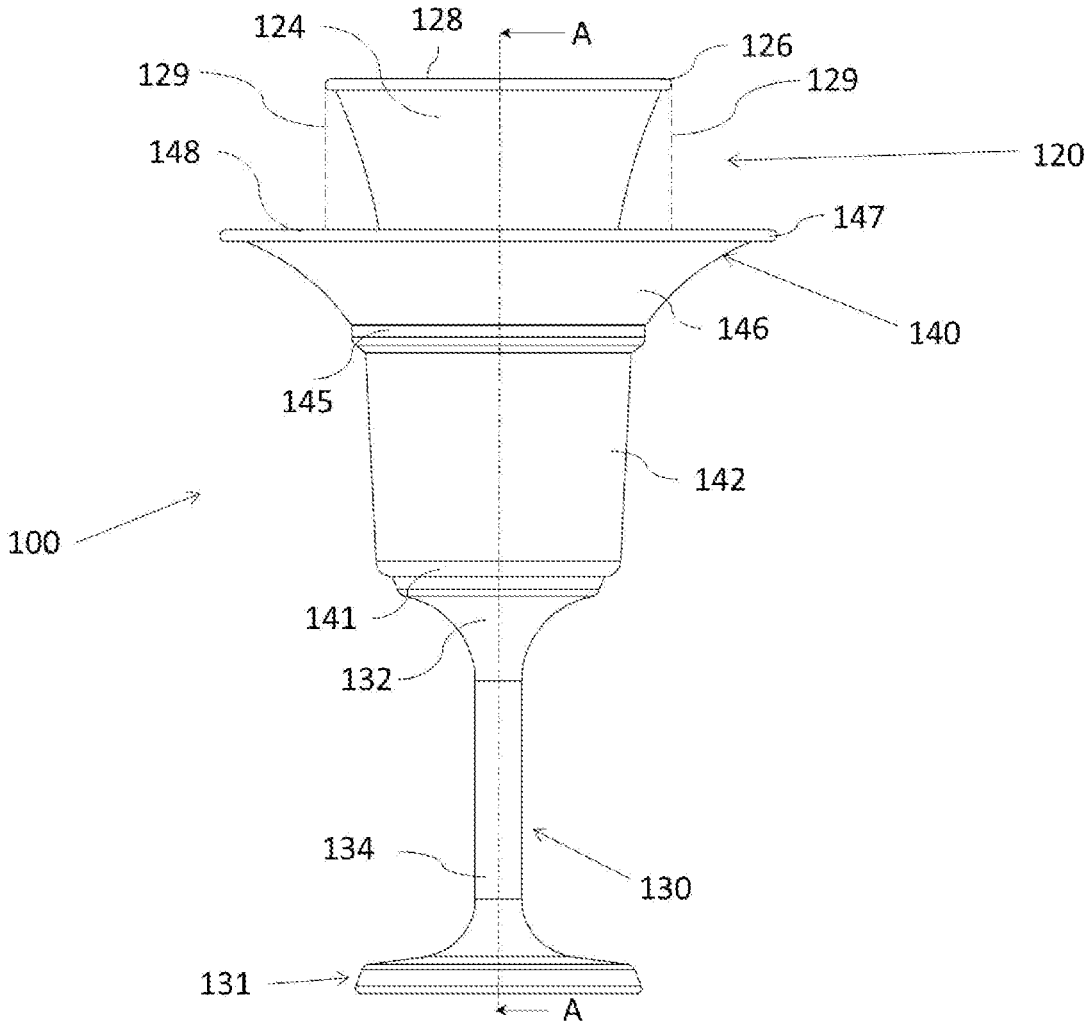
FIG. 2 depicts a side view representation of the drinking vessel according to an embodiment of the invention.
Figure 3:
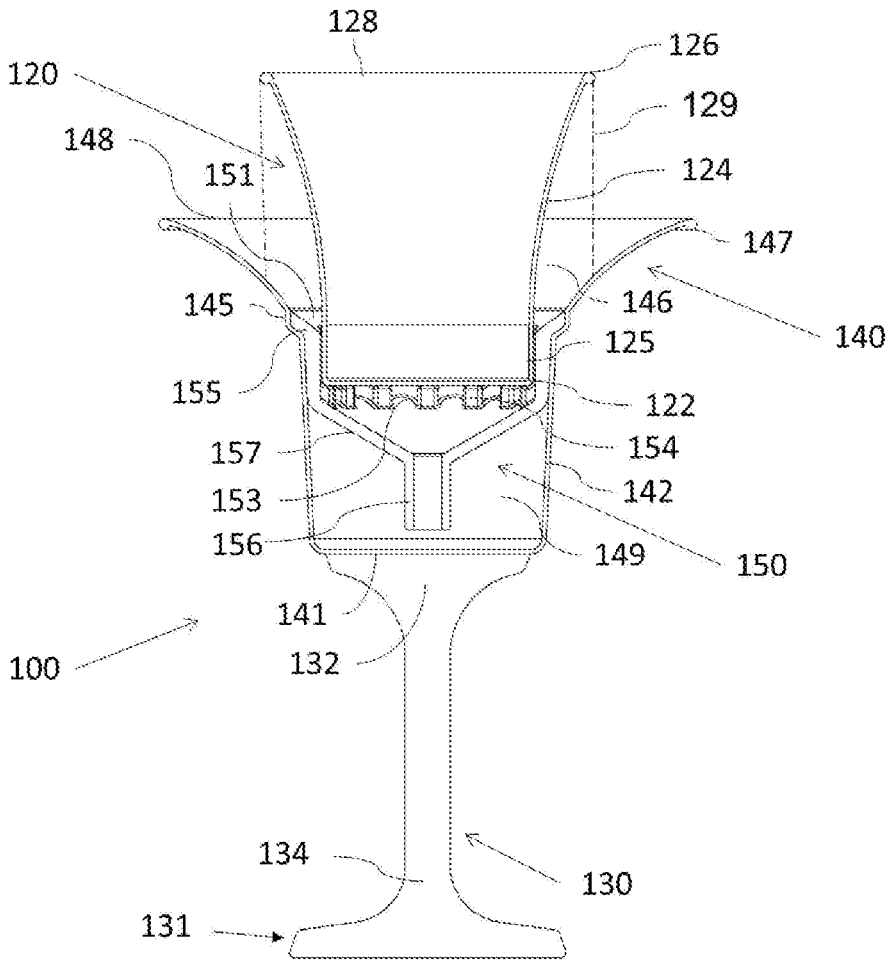
FIG. 3 depicts a cross sectional schematic representation of a drinking vessel according to an embodiment of the invention in accordance with FIG. 2.

Reference is now made to FIGS. 1, 2 and 3. A drinking vessel 100 comprises a beverage container 120, a spillage receptacle 140, an annulated draining surface 150 and a stem and base 130 (not shown in the three dimensional depiction of the dismantled vessel). The beverage container comprises a bottom end surface 122, a sidewall 124 extending from the edge of the bottom end surface 122 upwards to a top edge 126 defining a top end opening 128. In the embodiment depicted in FIGS. 1-3 the sidewall of the beverage container is convex (from a point of view inside the beverage container), but in other embodiments the sidewall may adopt any other form as well. The top end opening defines an imaginary vertical projection 129, such that when the drinking vessel is positioned in an upright position (e.g. when placed on a table), the vertical projection is the area under the top end opening. The beverage container 120 resides inside the annulated draining surface 150 which in the depicted embodiment is in a form of a funnel, and both the beverage container and funnel 140 reside inside the spillage receptacle 140.

The spillage receptacle has a bottom end surface 141 which is located under the bottom end surface of the 122 of the beverage container 120. In some other embodiments the bottom end surface of the spillage receptacle 141 may be located above the bottom end surface of the beverage container 120, and in such embodiments the bottom end surface 141 of the spillage receptacle configured as an annulated surface surrounding the beverage container 120. A sidewall 142 extends from the outer edge of the bottom end surface 141 upwards to a top edge 147 which defines a top end opening 148. The top end opening 148 excessively encompasses the vertical projection 129 of the beverage container, such that it effectively collects spillage from the beverage container 120. An upper sloped portion 146 of the sidewall 142 is convex (from an internal point of view), and slopped inwards, to effect drainage of spillage into the inner space of the spillage receptacle 140 through the funnel 150. In other embodiments the upper portion 146 may have straight walls but the advantage of a slopped wall is that it mitigates splashing outwards of spilled drops which fall and hit the surface of 146. A stepwise groove 145 having a shape and dimension which compatibly fits the outer top portion of the funnel 150 is located at the lower end of the upper sloped portion 146 of the sidewall. The stepwise groove 145 holds the funnel 150 in place and prevent the funnel 150 from sliding further downwards In some embodiments commonly known alternatives for reversibly holding the funnel 150 (or annulated draining surfaces) in place may be utilized and replace the stepwise groove, for example—a thread or an L-shaped lock groove.

The beverage container 120 is reversibly fixated to the spillage receptacle 140 by tightly pressing a lower section 125 of the sidewall of the beverage container 120 against the protruding ribs 152 of the sidewall of the funnel 150, which reside inside the spillage receptacle. In some embodiments the section of the sidewall of the funnel 150 which comprises the protruding ribs 152, is made from a material which may be compressed between the section 125 and the sidewall of the spillage receptacle 140. In some embodiments the section comprising the protruding ribs 152 is made from an elastic thermoset polymer. The surface of the protruding ribs 152 facing inwards (where the beverage container is supposed to reside) define an opening having a diameter which matches or is slightly smaller than the diameter of the beverage container along section 125 of the sidewall of the beverage container 120. The height of protruding ribs 152 should be sufficient to provide sufficient force for holding the beverage container 120 in place taking into account the weight of the beverage container while it is filled with a beverage. The person of skill in the art would know how to calculate and determine the required height of 125 such that it fulfills its functionality. In some embodiments the length of section 152 is 10% of the height of the beverage container 120. In some embodiments it is 20% of the height of the beverage container 120, and in some 30%. Pedestals 154 extending from the sidewall of the funnel 150 under section 152 function as a chassis for the beverage container 120. A top facing surface 151 of the funnel 150 extends outwards from the sidewall of the funnel to forming a collar shape around the funnel which fits in the stepwise groove 145 thus preventing the funnel 150 from falling into the spillage receptacle 140.

Longitudinal slots 153 alternately separate the protruding ribs 152 from each other. The longitudinal slots 153 begin at the top at the up-facing surface 151 of the funnel 150 and end at the bottom of the pedestals 154. Spillage received from the upper slopped section 146 of the spillage receptacle 140 slides along the upper facing surface 151 down through the longitudinal slots 153, then through the funnel stem 156 down to the lower section of the spillage receptacle defined by the sidewall 142. The number, dimensions and shape of slots 153 may vary in different embodiments.

The lower section 142 of the sidewall of the spillage receptacle 140 together with the bottom end surface 141, the annulated top surface 157 and the walls of the stem 156 facing the inner walls of the spillage receptacle 140 define a space 149 which holds the spillage after its collection, and prevents it from being spilled even when the drinking vessel 100 is tilted.

The funnel stem 156 may comprise a no-return valve to avoid return of spillage from the space 149 back to the up-facing surface of the funnel 150 and out of the spillage receptacle 150. In some embodiments the funnel stem 156 may have an L-shaped design for the same purpose, or other commonly used non-return means.

FIG. 1 represents an embodiment lacking a stem and base where the spillage receptacle 140 has a flat bottom 141 which serves as the base of the drinking vessel 100. In some embodiments such as that depicted in FIGS. 2 and 3, the drinking vessel further comprises a stem and a base 130. The stem comprises a top broadening end 132 through which it is connected to the bottom end surface 141 of the spillage receptacle 150, a base 131 and a rod like section 134 which connects the top end 132 and the base 131.

The narrow diameter of section 142 of the sidewall in comparison to the diameter of the top edge 147 of the spillage receptacle 140 provides an area by which the drinking vessel can be held while being protected from spillage. In embodiments which have a stem under the spillage receptacle as illustrated in FIGS. 2 and 3, the stem 130 provides an additional portion of the drinking vessel 100 being protected from spillage by the wider top edge 147 of the spillage receptacle 140.

Figure 4:
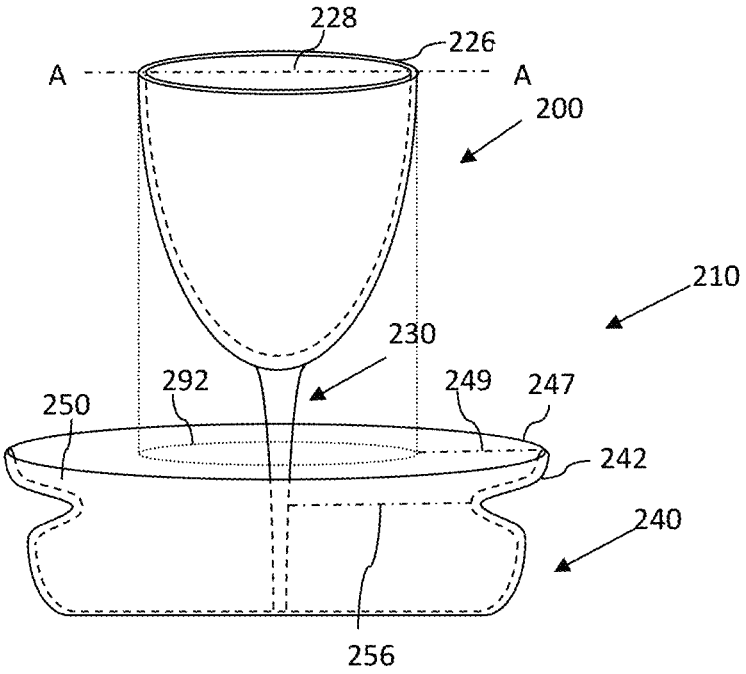
FIG. 4 depicts a three-dimensional schematic representation of a drinking vessel according to an embodiment of the invention.
Figure 5:
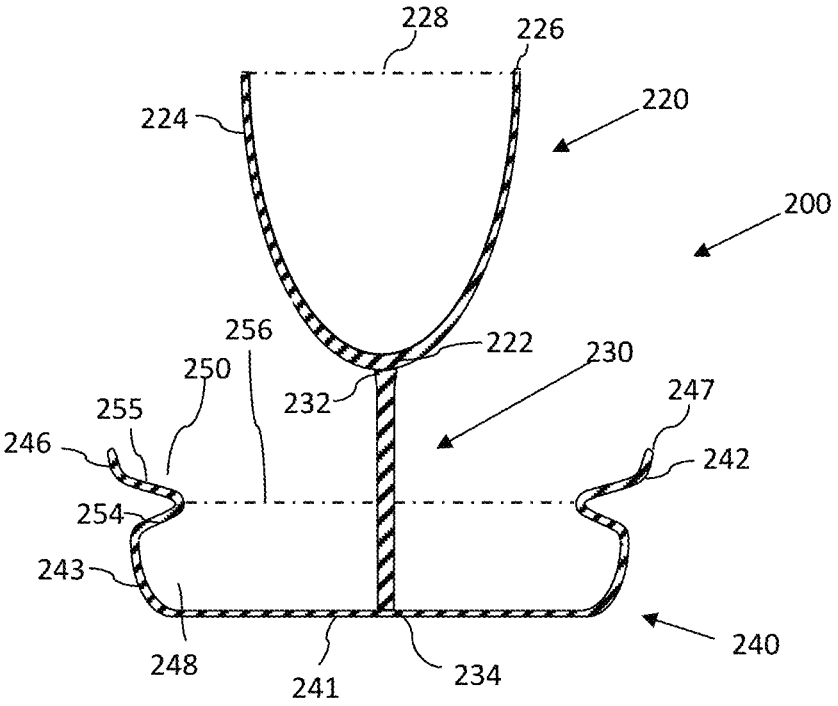
FIG. 5 depicts a cross sectional schematic representation of a drinking vessel according to the embodiment of the invention in accordance with FIG. 4.
Figure 6:
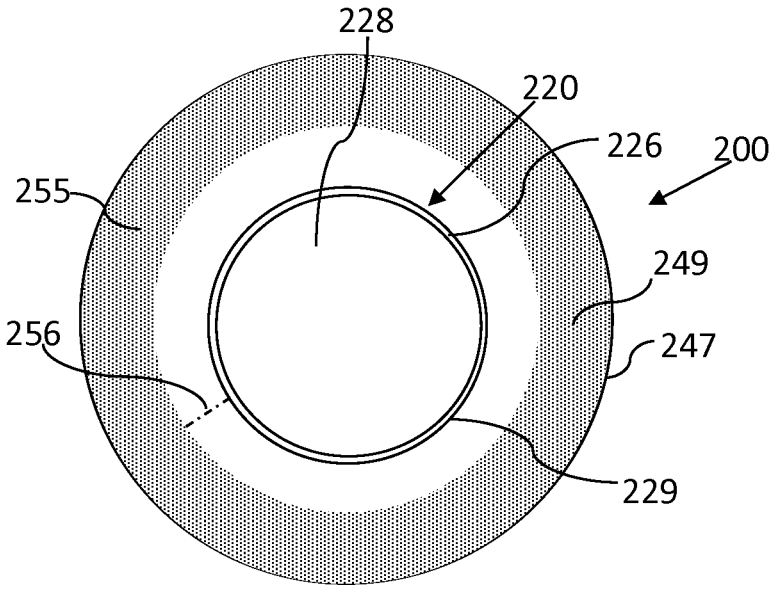
FIG. 6 depicts a top view schematic representation of the drinking vessel according to the embodiment of the invention in accordance with FIG. 4 and FIG. 5.

Reference is now made to FIGS. 4, 5 and 6 depicting a three dimensional representation, a schematic cross-section exemplary, and a top view representation, respectively, of a drinking vessel 200 according to an embodiment of another aspect of the invention. FIG. 5 is a cross sectional representation along line A-A in FIG. 4. The drinking vessel 200 comprises a beverage container 220, a stem 230 and a spillage receptacle 240.

The beverage container 220 comprises a bottom end surface 222, a sidewall 224, a top edge (or top end) 226, and a top end opening 228 (or "opening"). The opening 228 allows the pouring of a beverage into the beverage container 220 and drinking the beverage therefrom, and the interior walls of the beverage container 220 hold the beverage when the drinking vessel is in an up-right position. In the exemplary embodiment of FIGS. 4 to 6, the peripheral outer wall of the top end 226 is also the widest outer periphery of the beverage container.

The stem 230, having a longitudinal rod like structure with a top end 232 and a bottom end surface 234, is located under the beverage container 220. The stem 230 can be filled or hollow, or partially filled and partially hollow. The outer wall of the bottom end surface 222 of the beverage container is integrally connected to the top end 232 of the stem 230. The bottom end surface 234 of the stem 230 is integrally connected to a bottom end surface 241 of the spillage receptacle 240 positioned below the stem 230. In some embodiments the bottom end surface 234 of the stem is detachably connected of the to the bottom end surface 241 of the spillage receptacle 240 (for example, by screwing the bottom end surface 234 of the stem 230 into a thread in the bottom end surface 241) allowing convenient cleaning of the latter. The bottom end surface 241 of the spillage receptacle 200 in this exemplary embodiment is flat and thus also serves as the base of the drinking vessel 200. In other embodiments, the spillage receptacle can be further attached through a further stem to a separate flat base.

The spillage receptacle 240 has a side wall 242 extending from the edge of the bottom end surface 241 adapted to collect and drain spillage into the receptacle, a peripheral top end 247. FIG. 1 clearly illustrates that the peripheral top end 247 of the spillage receptacle 240 excessively encompasses the vertical projection 229 of the outer wall of the peripheral top end 226 of the beverage container 220 (the widest outer periphery of the beverage container 220 in this embodiment) by a sufficient margin 249 for collecting the spillage from the beverage container 220.

In this specific embodiment illustrated in FIGS. 4 to 6, the lower section 243 of the side wall 242 is concave (from an interior perspective, i.e., from the inside the spillage receptacle 240), the combination of sections 254 and 255 is convex, and the top section 246 of the side wall is concave again. The concave surface of 243 and the lower part of the convex surface 254 facing the bottom end surface of the spillage receptacle 240 generates a groove 248 which is capable of holding the spillage liquid even when the vessel 200 is tilted for drinking. Section 254 of the sidewall 242 facing the bottom end surface 241 of the spillage receptacle 240, defines an annulated top surface of this exemplary embodiment. Section 255 (the convex section), facing the opening 228 of the beverage container 220 functions as an annulated draining surface: drops of spillage which are splashed out from the beverage container 220 or missed while being poured from the bottle of the beverage (or any other source of the beverage) and hit section 255 of the annulated top surface 250, slide downward through the aperture 256 into the spillage receptacle 240.

The overall height of the sidewall 242 may vary according to the preferred design. According to the embodiment of the invention depicted here, the height is short enough to expose the stem and make it accessible for holding the drinking vessel by hand. Therefore, according this embodiment the highest point of the spillage receptacle 240 should be lower than the highest point of the stem 232 sufficiently to enable access to the stem for holding it, in some embodiments by at least 2 cm and in some embodiments by at least 3 cm. It should also be taken into account that embodiments having a shorter height of the concave section of the sidewall 242 should be compensated with a deeper concave curvature as to enable the capture of the spillage liquids when the drinking vessel 200 is tilted for drinking.

With reference to the top view in FIG. 6, note that the margin 249 is the distance between the vertical projection of the widest outer periphery 229 (which from a top view overlaps the outer wall of the peripheral top end 226) and the peripheral top end 247.

Figure 7:
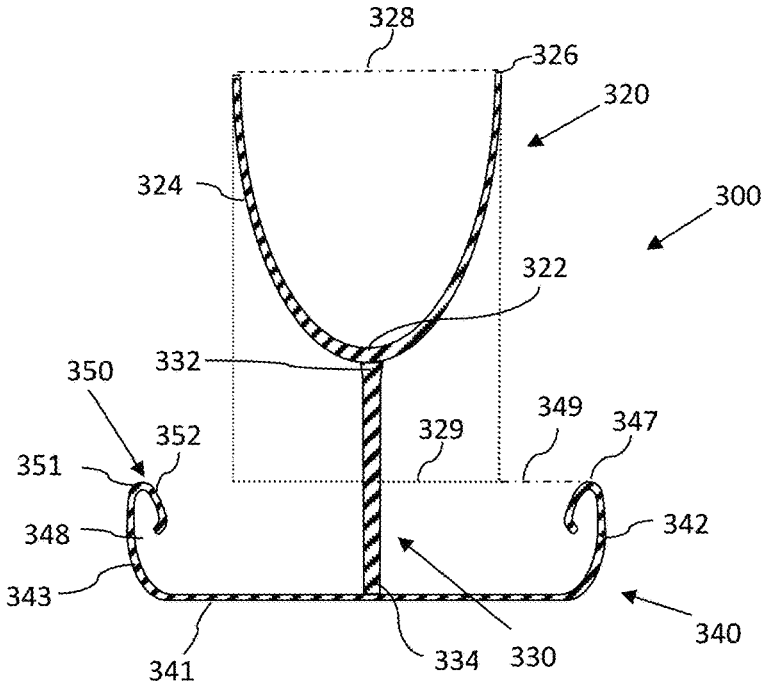
FIG. 7 depicts a cross sectional schematic representation of a drinking vessel according to another embodiment of the invention.

Reference is now made to FIG. 7 depicting a schematic representation of a drinking vessel 300 according to an embodiment of the invention. The drinking vessel 300 is identical to the embodiment depicted in FIGS. 4 to 6 except for the spillage receptacle 340 which is modified. Identical parts having an identical function as in the embodiment depicted in FIGS. 4 and 5 are given corresponding reference numbers with the same last two digits (e.g. 328 is equivalent to 228, 341 is equivalent to 241 etc.). Only the differences between the embodiment of FIG. 4 and the embodiment of FIGS. 1 and 2 are detailed hereby.

The sidewall 342 of the spillage receptacle 340 extends upward from the edge of the bottom end surface 341, with a slight concave conformation at 343 (from an interior point of view). At section 351, the surface extends upward and inward with respect to the center of the spillage receptacle 340 until reaching the peripheral top end 347 where the wall begins to curve inwards and downwards at section 352. In some other embodiments, the surface may begin curving inward and downward without first extending upward and inward. The combination of the inner side of sections 351 and 352 define the annulated top surface 350 of the spillage receptacle 340. The surface of 352 which faces the beverage container 320 defines and functions as a draining surface: liquid that is spilled from the beverage container 320 and falls within the area defined by the peripheral top end 347 slides along section 352, into the spillage receptacle 340. The sidewall 342 and the annulated top surface 350 define a groove 348 which captures the collected spillage and prevents it from dropping out of the spillage receptacle 340 while the drinking vessel 300 is strongly tilted for drinking.

The peripheral top end 347 defines a top opening 348 which excessively encompasses the vertical projection 329 of the outer wall of the peripheral top end 326 of the beverage container 320 by a margin 349. The margin 349 is adequate for collecting spillage that is splashed away from the outer sidewall 324 of the beverage container 320.

Figure 8:
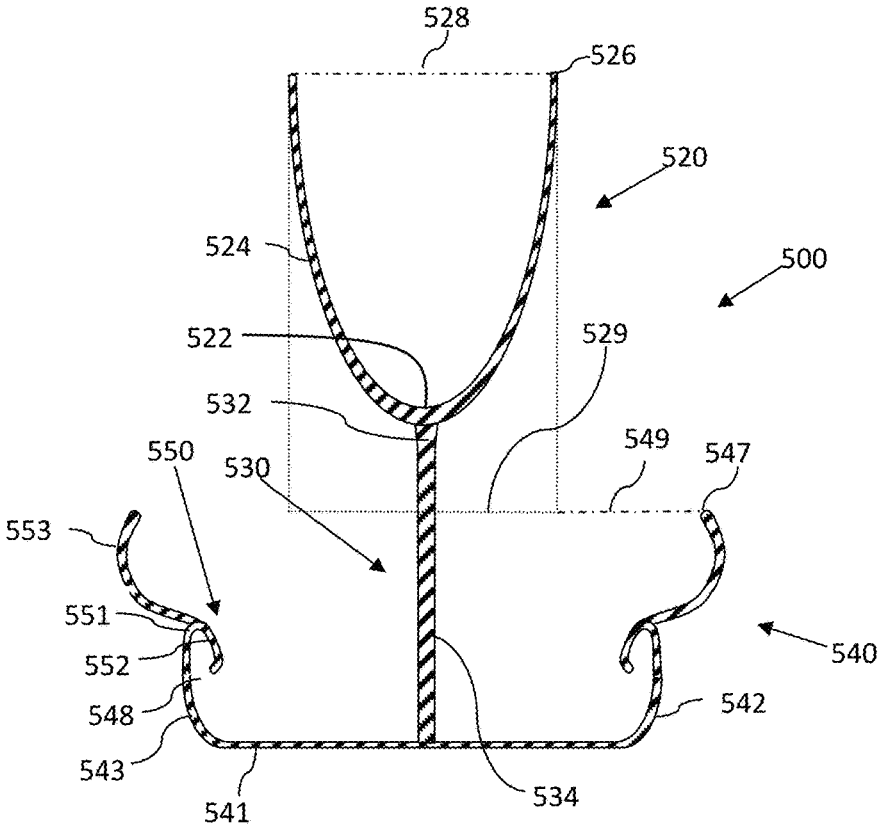
FIG. 8 depicts a cross sectional schematic representation of a drinking vessel according to another embodiment of the invention.

FIG. 8 is a schematic cross-section of a drinking vessel 400 according to yet another embodiment of the invention. The drinking vessel 400 is identical to the embodiment depicted in FIG. 7 except for an extension 453 to the sidewall 442 of the spillage receptacle 440. Identical parts having an identical function as in the embodiment depicted in FIG. 7 are given corresponding reference numbers with same last two digits (e.g. 428 is equivalent to 328, 441 is equivalent to 341 etc.). Only the differences between FIGS. 8 and 7 are detailed hereby.

A wall 453 extends outward from the annulated top end of the spillage receptacle 450. Section 452 together with the extension wall 453 define a top draining surface which drains spillage from the beverage container into the spillage receptacle. The extension of the wall 453 provides a wider peripheral top end 447 and a wider margin 449 in comparison with the corresponding peripheral top end 347 and margin 349 of the embodiment depicted in FIG. 7. The extension wall 453 in the embodiment depicted in FIG. 8 is concave (from an interior point of view). In other embodiments the extension wall 453 can be designed to have a concave structure or an S like configuration (concave-convex).

The drinking vessel 400 sets an exemplary embodiment of having the top annulated surface 450 extending from along the sidewall 442 instead of from the top of the sidewall as in previous exemplary embodiments.

Figure 9:
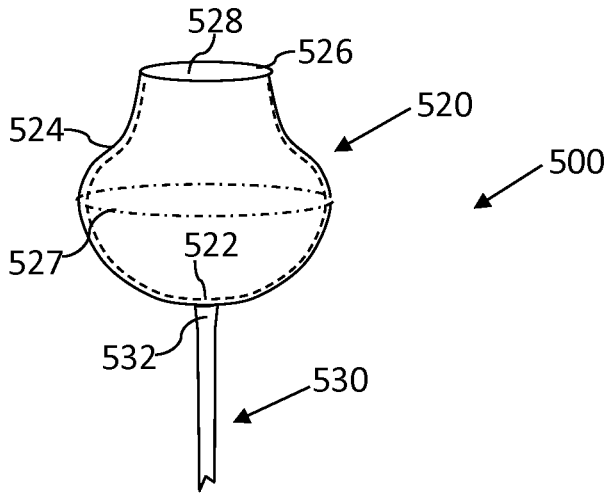
FIG. 9 depicts a three dimensional representation of part of a drinking vessel according to another embodiment of the invention.

Reference is now made to FIG. 9 depicting a drinking vessel 500 according to further embodiment of the invention. FIG. 9 shows only the beverage container 520 and the upper section of the stem 530. The beverage container 520 comprises, as in the previous examples, a bottom end surface 522, a sidewall 524, a top end 526 and an opening 528. In this embodiment, due to the pear-shape of the beverage container, the widest outer periphery 529 does not overlap with the top end 526 as in previous embodiments but is rather proximal to the bottom end surface 522 of the beverage container 520.

According to the invention the top end opening of the spillage receptacle of drinking vessel 500 needs to be sufficiently wider than the widest outer periphery 529, if the top end of the spillage receptacle is lower than the widest outer periphery 529 of the beverage container 520.

The invention claimed is:

1. A drinking vessel comprising:

a beverage container comprising a bottom end surface and a sidewall extending upward from the outer edge of the bottom end surface to a top edge defining a top end opening;

a spillage receptacle having a bottom end surface, a sidewall extending upward from an outer edge of the bottom end surface of the spillage receptacle to a top edge defining a top end opening of the spillage receptacle encompassing a vertical projection of the top end opening of the beverage container, the bottom end surface of the spillage receptacle being lower than the top end opening of the beverage container; and an annulated draining surface situated inside the spillage receptacle, having a top edge defining a top end opening, a sidewall and drainage means, adapted to drain spillage comprising trajectile drops from the beverage container into the spillage receptacle including when the drinking vessel is still;

wherein the spillage receptacle comprises a cover to a portion of the drinking vessel, the portion being intended to be held by the holder, by having a peripheral holding portion of the sidewall of the drinking vessel being below the top end opening of the spillage receptacle, the peripheral holding portion being exposed for holding the drinking vessel, and having a vertical length of at least 2 cm and a diameter at least 2 cm shorter than the diameter of the top end opening of the spillage receptacle.

2. The drinking vessel according to claim 1 wherein the top end opening of the spillage receptacle is larger than the top end opening of the beverage container by a radial excess of at least 5% at each point around the circumference of the top end opening of the beverage container.

3. The drinking vessel according to claim 1 wherein the top end opening of the spillage receptacle is larger than the top end opening of the beverage container by a margin of at least 5 mm and up to 200 mm from the vertical projection of each point of the circumference of the opening of the beverage container.

4. The drinking vessel according to claim 1 wherein the top end opening of the spillage receptacle is larger than the opening of the beverage container by a margin which collects above 90% of the spilled drops in model tests.

5. The drinking vessel according to claim 1 wherein the lowest point of the bottom end surface of the spillage receptacle is positioned below the bottom end surface of the beverage container.

6. The drinking vessel according to claim 1 wherein the sidewall of the spillage receptacle is surrounding at least a portion of the beverage container.

7. The drinking vessel according to claim 1 wherein at least a portion of the top end opening of the spillage receptacle is lower than the top end opening of the beverage container.

8. The drinking vessel according to claim 1 wherein the annulated draining surface is adapted to fit in the gap between the beverage container and the spillage receptacle.

9. The drinking vessel according to claim 1 wherein the annulated draining surface comprising an inner sidewall portion being in contact with the outer sidewall of the beverage container and comprising a fixation mechanism for fixating the beverage container.

10. The drinking vessel according to claim 1 wherein the beverage container and the annulated draining surface being reversibly connected.

11. The drinking vessel according to claim 1 wherein the spillage receptacle and the annulated draining surface being reversibly connected.

12. The drinking vessel according to claim 1 wherein the annulated draining surface comprises at least one of an aperture, slit, slot, open ended stem or a plurality thereof allowing drops of spillage to drain into the inner space of the spillage receptacle.

13. The drinking vessel according to claim 1 wherein the annulated draining surface is a funnel.

14. The drinking vessel according to claim 9 wherein the fixation mechanism of the annulated draining surface is at least one of: a thread compatible with a screw structure of the beverage container, being made of an elastomeric material and having dimensions slightly smaller than the beverage container adapted to press against the walls of the beverage container and the spillage receptacle, a locking groove compatible with a protrusion on the beverage container.

15. The drinking vessel according to claim 1 wherein said drinking vessel is a Kiddush cup.

16. A kit comprising a drinking vessel according to claim 1 and instructions for using the drinking vessel in a Kiddush.

17. A drinking vessel according to claim 1, further comprising a stem longitudinally extending downward from the bottom end surface of the spillage receptacle and connected to a base.

18. A drinking vessel comprising:

a beverage container comprising a bottom end surface, and a sidewall extending upward from the outer edge of the bottom end surface to a top edge defining a top end opening;

a spillage receptacle having a bottom end surface, a sidewall extending upward from an outer edge of the bottom end surface of the spillage receptacle to a top edge defining a top end opening, the bottom end surface of the spillage receptacle being lower than the top end opening of the beverage container; and an annulated draining surface situated between the beverage container and the spillage receptacle, having a top edge defining a top end opening positioned above the top end opening of the spillage receptacle and encompassing the vertical projection of the top end opening of the beverage container, a sidewall and drainage means, adapted to drain spillage comprising trajectile drops from the beverage container into the spillage receptacle including when the drinking vessel is still;

wherein the spillage receptacle comprises a cover to a portion of the drinking vessel, the portion being intended to be held by the holder, by having a peripheral holding portion of the sidewall of the drinking vessel being below the top end opening of the annulated draining surface, the peripheral holding portion being exposed for holding the drinking vessel, and having a vertical length of at least 2 cm and a diameter at least 2 cm shorter than the diameter of the top end opening of the annulated draining surface.

19. The drinking vessel according to claim 18 for use as a Kiddush cup.

20. A kit comprising a drinking vessel according to claim 18 and instructions for using the drinking vessel in a Kiddush.

21. A drinking vessel according to claim 18, further comprising a stem longitudinally extending downward from the bottom end surface of the spillage receptacle and connected to a base.

* * * * *